US011585140B2

(12) United States Patent
Terno

(10) Patent No.: US 11,585,140 B2
(45) Date of Patent: Feb. 21, 2023

(54) SHOCK-ABSORBING BRAKING DEVICE FOR SLIDING PANELS AND DOORS

(71) Applicant: TERNO SCORREVOLI S.P.A. UNIPERSONALE, Varedo (IT)

(72) Inventor: Giovanni Terno, Varedo (IT)

(73) Assignee: TERNO SCORREVOLI S.P.A. UNIPERSONALE, Varedo (IT)

( * ) Notice: Subject to any disclaimer, the term of this patent is extended or adjusted under 35 U.S.C. 154(b) by 83 days.

(21) Appl. No.: 17/270,642

(22) PCT Filed: Aug. 2, 2019

(86) PCT No.: PCT/EP2019/025253
§ 371 (c)(1),
(2) Date: Feb. 23, 2021

(87) PCT Pub. No.: WO2020/048631
PCT Pub. Date: Mar. 12, 2020

(65) Prior Publication Data

US 2021/0340803 A1 Nov. 4, 2021

(30) Foreign Application Priority Data

Sep. 6, 2018 (IT) ..... 102018000008395

(51) Int. Cl.
*E05F 5/00* (2017.01)
*E05F 1/16* (2006.01)

(52) U.S. Cl.
CPC ..... *E05F 5/003* (2013.01); *E05F 1/16* (2013.01); *E05Y 2201/64* (2013.01);
(Continued)

(58) Field of Classification Search
CPC .... E05F 5/003; E05F 1/16; E05F 3/00; E05Y 2900/132; E05Y 2201/64; E05Y 2201/708; E05Y 2800/24
See application file for complete search history.

(56) References Cited

U.S. PATENT DOCUMENTS 2,951,383 A * 9/1960 Herider ..... G05G 7/00 74/88
8,240,788 B2 * 8/2012 Juan ..... A47B 88/49 312/333

(Continued)

FOREIGN PATENT DOCUMENTS

CA 2881038 A1 8/2016
CN 104727680 A 6/2015

(Continued)

OTHER PUBLICATIONS

International Search Report & Written Opinion received for the PCT Application No. PCT/EP2019/025253, dated Nov. 7, 2019, 9 pages.

(Continued)

*Primary Examiner* — Victor D Batson
*Assistant Examiner* — Matthew J Sullivan
(74) *Attorney, Agent, or Firm* — Steven M. Hertzberg

(57) ABSTRACT

A shock-absorbing braking device (10) for sliding doors (88) or for wardrobe panels is combined with a carriage (12) provided with rollers (14) sliding in an extruded profile (16), with a bottom base provided with a longitudinally extending slot (18) from which a pin or bolt (20) protrudes suitable to connect said carriage (12) to the sliding door or panel (88). The device comprises a containment shell (24), formed of opposite and complementary elements (28), in which at least one helical spring (26) and a shock-absorbing piston (30) acting in conjunction with a shaped cam (56) are placed, provided with an appendage forming a traction hook (62) suitable to abut with an activator (78) extending in said extruded profile (16). The shaped cam (56) is provided on opposite sides with a pin (64), destined to slide along a mixtilinear cavity (66, 66') extending longitudinally along (Continued)

Figure 1:
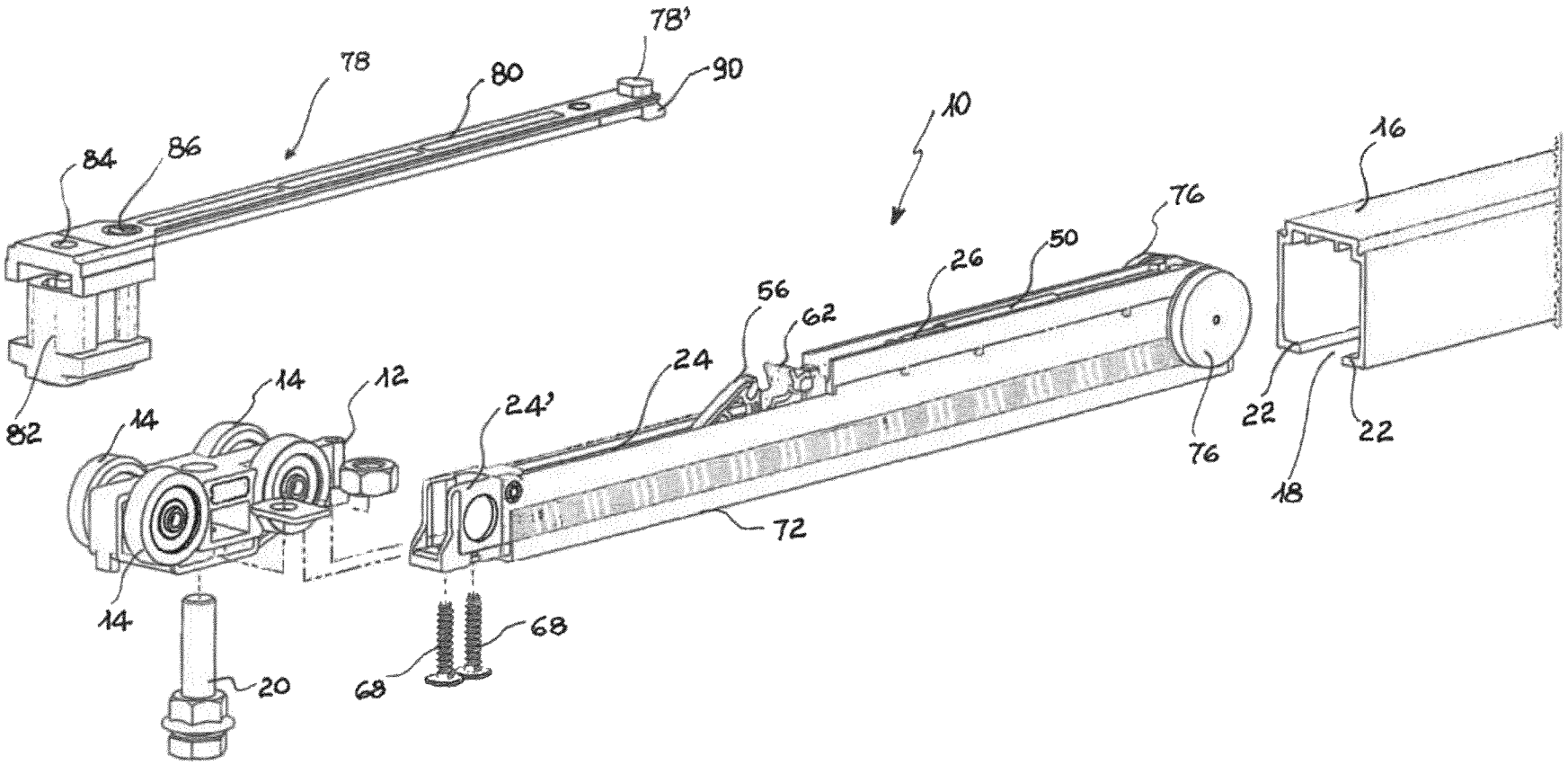

Fig. 6 the inner face of each of the elements (28) forming the containment shell (24).

14 Claims, 5 Drawing Sheets

(52) U.S. Cl.
CPC ... *E05Y 2201/708* (2013.01); *E05Y 2800/205* (2013.01); *E05Y 2800/24* (2013.01); *E05Y 2800/242* (2013.01); *E05Y 2900/132* (2013.01); *E05Y 2900/20* (2013.01)

(56) References Cited

U.S. PATENT DOCUMENTS

| | | | | |
|---|---|---|---|---|
| 8,651,597 | B2 * | 2/2014 | Kimura | E05F 5/003 312/319.1 |
| 8,714,671 | B2 * | 5/2014 | Huang | A47B 88/467 312/319.2 |
| 8,745,821 | B2 * | 6/2014 | Chang | E05F 5/003 16/49 |
| 9,388,622 | B1 * | 7/2016 | Paron | E05F 15/56 |
| 9,765,559 | B2 * | 9/2017 | Shin | E05F 1/16 |
| 9,885,206 | B2 * | 2/2018 | Shin | E05F 5/003 |
| 10,221,604 | B2 * | 3/2019 | Zimmer | E05F 1/16 |
| 10,745,955 | B2 * | 8/2020 | Svara | E05F 1/16 |
| 2009/0121596 | A1 * | 5/2009 | Ferrari | E05F 5/003 312/319.1 |
| 2013/0160240 | A1 * | 6/2013 | Kenny | E05D 15/0626 16/89 |
| 2016/0333622 | A1 * | 11/2016 | Glogowski | E05F 3/18 |
| 2020/0190882 | A1 * | 6/2020 | Bantle | E05F 5/06 |
| 2021/0324668 | A1 * | 10/2021 | Stratico | E05C 17/60 |
| 2021/0381293 | A1 * | 12/2021 | Zimmer | E05F 5/003 |
| 2022/0154507 | A1 * | 5/2022 | Knoth | E05F 5/003 |

FOREIGN PATENT DOCUMENTS

| | | | |
|---|---|---|---|
| EP | 2886769 | A1 | 6/2015 |
| EP | 3095941 | A1 | 11/2016 |

OTHER PUBLICATIONS

International Preliminary Report on Patentability received for the PCT Application No. PCT/EP2019/025253, dated Mar. 18, 2021, 8 pages.

* cited by examiner 76
76'
70
28
28'
50
52
44
44'
26
30
30'
42
46
48
60
54
34
58
64
56
32
62
66
66'
24'
72
74
36
38
40

SHOCK-ABSORBING BRAKING DEVICE FOR SLIDING PANELS AND DOORS

CROSS REFERENCE TO RELATED APPLICATION

This application claims benefit under 35 U.S.C. § 371 to international application No. PCT/EP2019/025253 filed on Aug. 2, 2019, which claims priority to Italian application No. 102018000008395 filed Sep. 6, 2018, the contents of which are incorporated by reference in their entireties.

The present invention relates to a shock-absorbing braking device for sliding panels and doors.

More particularly, the present invention relates to a device specially adapted to slide sliding doors or wardrobe panels, making sure that they do not violently impact with the respective end stops, in opening and closing.

The use of sliding doors is well-known and widespread especially for the purpose of closing the passageway between two rooms without causing encumbrance and detracting from the available space, since they do not protrude angularly during the opening phase but slide parallel to the wall on which the passageway opening is made; in some cases, these sliding doors are of the retractable type, since during the opening phase they are housed in a special seat made in the thickness of the wall. The movement of said sliding doors is traditionally carried out by means of special carriages, which move along a sliding guide arranged at the top of the opening and are generally connected to the upper edge of the door. The sliding guide of the carriages typically consists of an extruded aluminium profile, in which a longitudinally extending seat houses the carriages and delimits their movement at the opposite sides.

In some wardrobes too, the doors do not open cantilevered, rotating on the hinges that support them on one side, but slide frontally to open or close, totally or partially, the access to the respective compartments. This solution helps reduce encumbrance, since the doors do not take up space when they are opened.

A problem particularly felt in relation to sliding doors, as well as for wardrobe panels, concerns their movement in opening and closing, since the user does not always push them gradually as far as the end stop; although inadvertently, the thrust exerted on them is excessive and causes a sometimes violent impact of the same at the end of the stroke. This event, in addition to the unwanted noise caused, is also capable of causing significant damage to the carriages over time, which may even come out of the sliding guide and thus require laborious repair work. In order to avoid these possible drawbacks, specific devices have been designed to gradually accompany the panel or doors to the end stop, in opening and closing; these devices typically comprise a spring, usually traction, that connects the structure of the braking element to the traction hook; the hook performs the dragging of the door or panel to the end stop position.

EP 3 095 941 for example divulges an automatic braking device for sliding doors the compact shape of which allows it to be used even on doors of extremely limited width; the device comprises at least one pair of springs that are subjected to angular displacements being integral with a traction hook or slider that tilts by different degrees. The latter consists of two components, one connected to the shock-absorber or brake piston, the other connected only to the springs.

The Chinese patent CN 104727680 discloses an elastic oscillating roller device for a sliding door, with a fixed component, a movable component, a trigger device, and a return and/or damping device. The braking system of the device is hinged freely to the axis of rotation of the wheels.

EP 2 886 769 discloses a combined slider for a sliding door mechanism, comprising a carriage attachable to a sliding door and a tie rod with damping device. The traction and damping element is hinged to the carriage.

However, these well-known construction solutions present a major drawback, especially with regard to the sliding doors separating two rooms; the drawback relates to the fact that the traction hook is directly subjected to the traction of the spring and to cause it to be unlocked a lot of force needs to be applied, hence making a large amount of noise. In particular, the spring is subjected to angular displacements being integral with the hook that tilts by different degrees; the noise generated is transmitted to the sliding and, consequently, to the door.

The purpose of the present invention is to overcome the drawbacks complained of above.

More particularly, the purpose of the present invention is to provide a shock-absorbing braking device for doors or panels capable of allowing the movement of said doors, both in opening and closing, applying a limited force and thus preventing a loud noise.

A further and related purpose of the invention is to provide a shock-absorbing device as defined above, suitable to allow a silent coupling of the means provided both for hooking and pulling and for release upon opening, any need for angular displacement of the elastic means, typically consisting of helical springs, being excluded. A further, no less important purpose of the invention is to provide a shock-absorbing device capable of allowing users to move the doors silently and easily in the various situations that arise, even in the case of partial or limited movements of said doors.

A further purpose of the invention is to make available to users a shock-absorbing braking device suitable to ensure a high level of resistance and reliability over time, in addition such as to be easily and economically made.

These and other purposes are achieved by the shock-absorbing braking device of the present invention according to the main claim.

Figures 2, 2A, 2B:
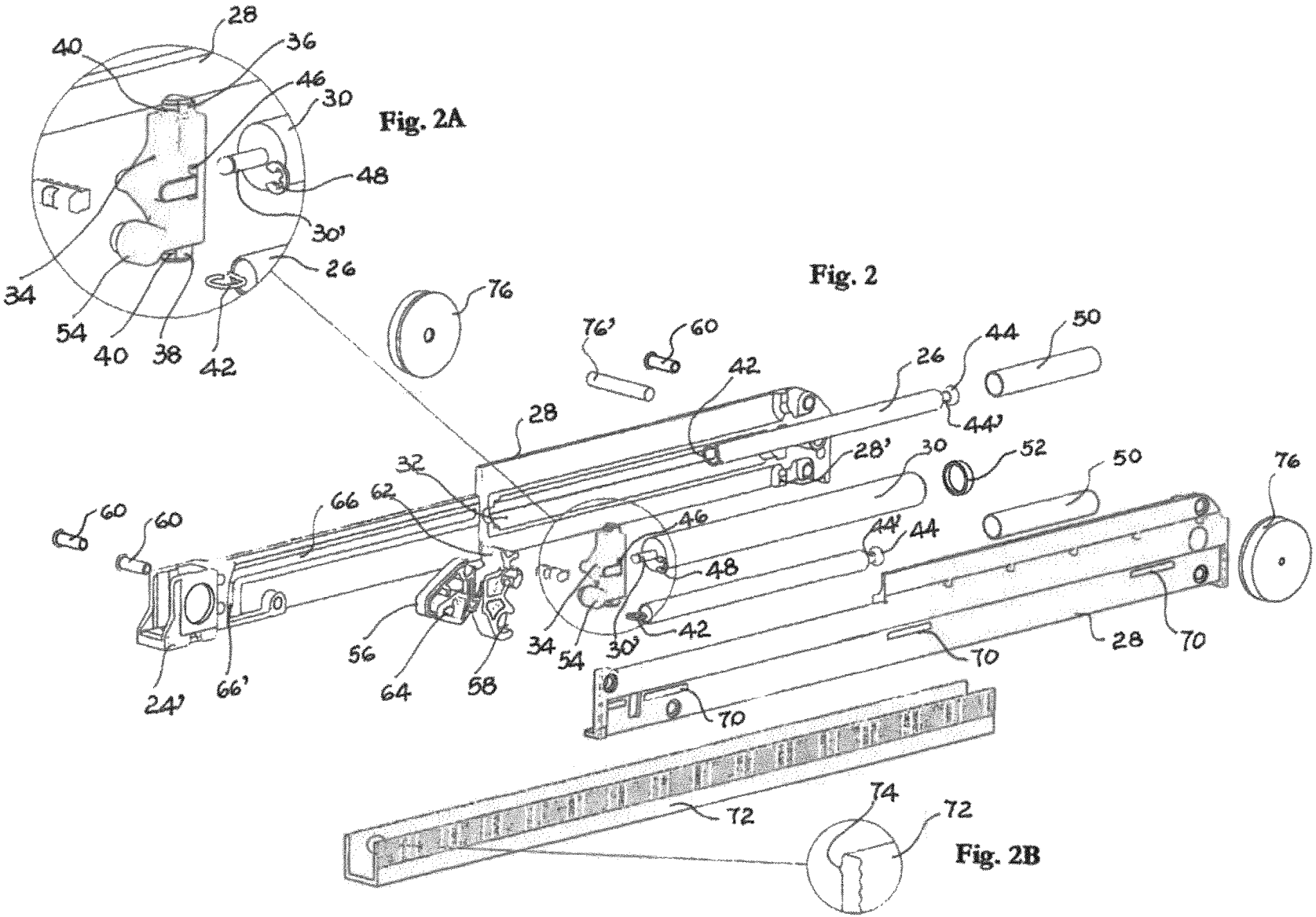
Figure 4:
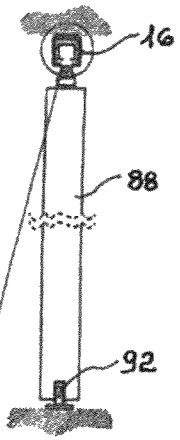
Figure 4A:
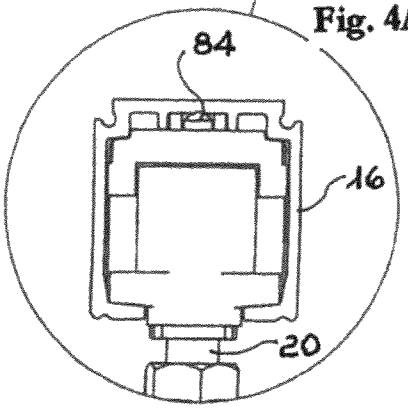
Figure 3:
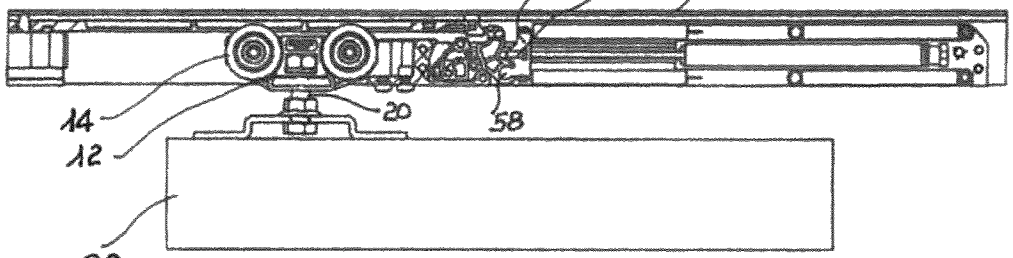
Figure 3A:
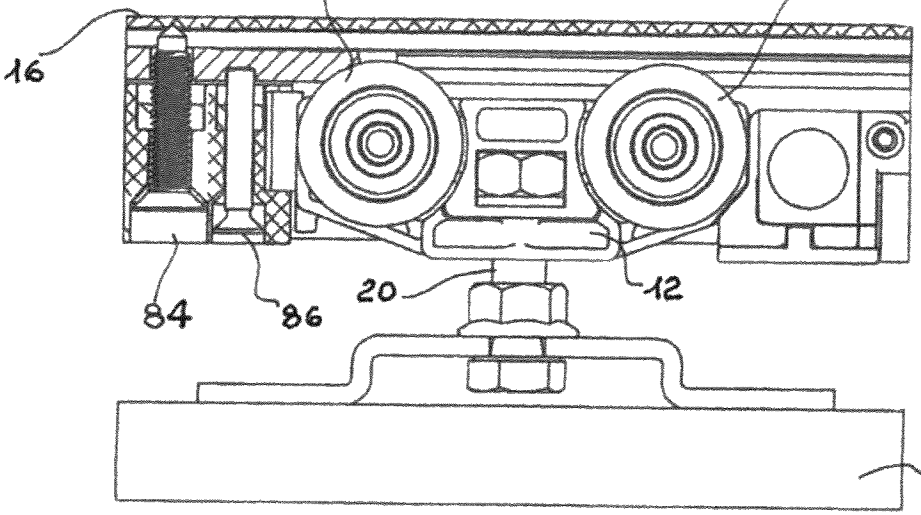
Figure 5:
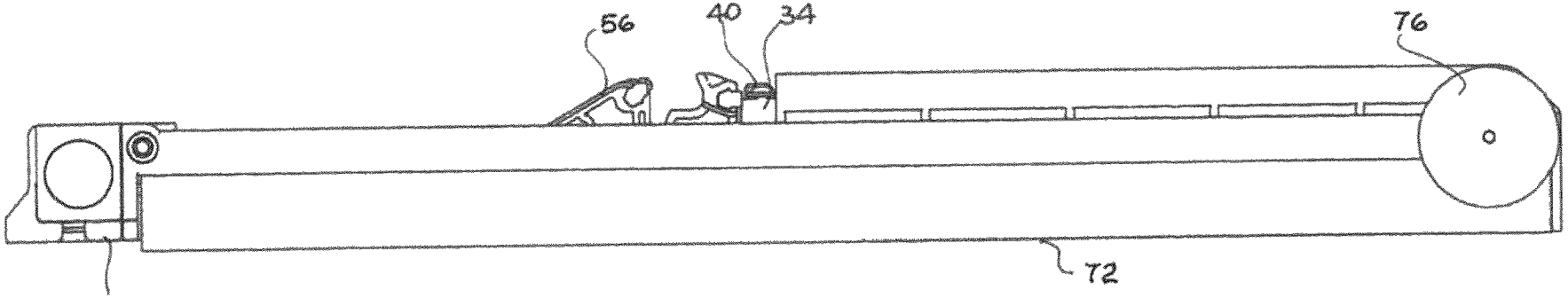
Figure 6:
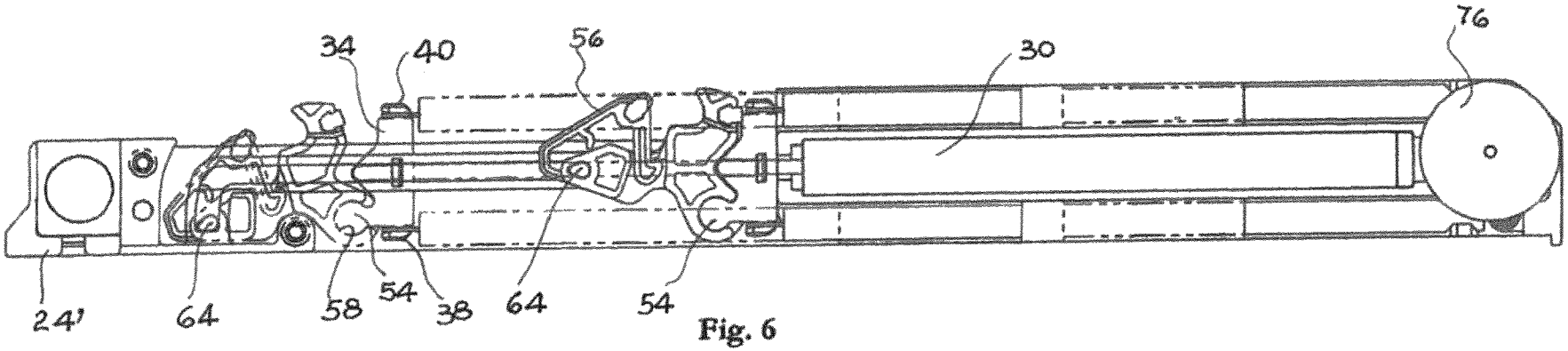
Figure 7:
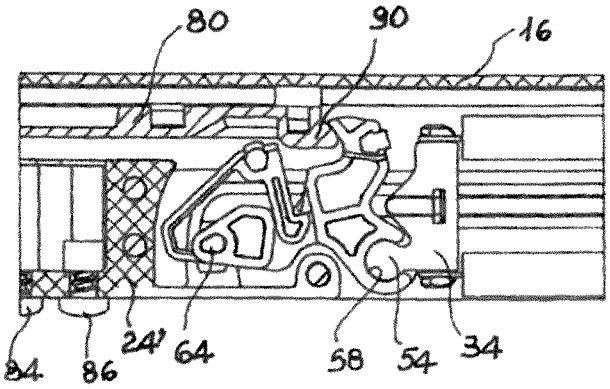
Figure 8:
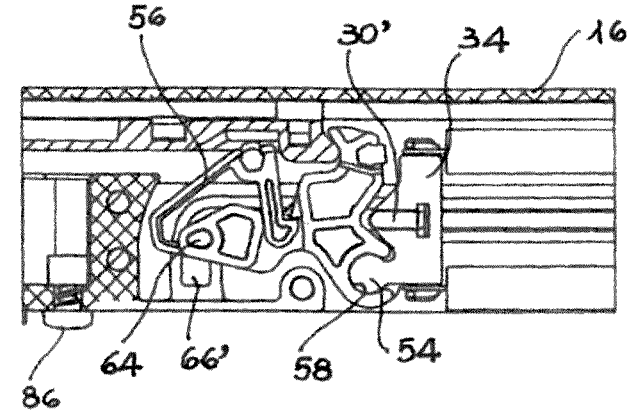
Figure 9:
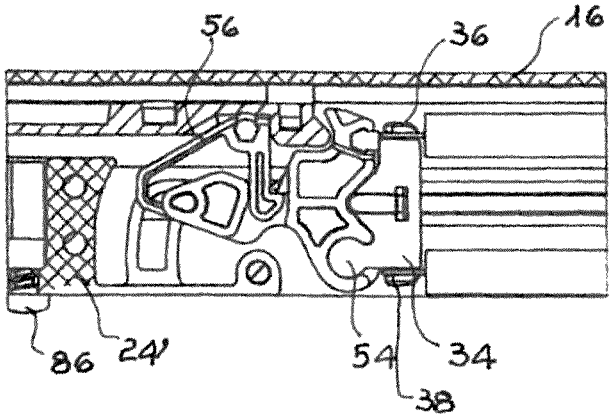

The construction and functional characteristics of the shock-absorbing braking device of the present invention will be more clearly comprehensible from the detailed description below in which reference is made to the appended drawings which show a preferred embodiment and wherein:

FIG. 1 schematically represents an axonometric view of the shock-absorbing braking device of the present invention;

FIG. 2 schematically shows an exploded view of the same device;

FIG. 2A schematically shows an enlarged detail of FIG. 2;

FIG. 2B schematically shows a further enlarged detail of the same FIG. 2;

FIG. 3 schematically shows a side view in partial cross-section of the device of the invention applied to a sliding door;

FIG. 3A schematically shows an enlarged detail of FIG. 3;

FIG. 4 schematically shows a front view of FIG. 3;

FIG. 4A schematically shows an enlarged detail of FIG. 4;

FIG. 5 schematically shows a side view of the device of the invention;

FIG. 6 schematically shows a further side view of the device according to the invention;

FIGS. 7, 8 and 9 schematically show as many positions of a cam of the device of the invention during its activation.

With initial reference to FIG. 1, the shock-absorbing braking device of the present invention, globally denoted by reference numeral 10, is combined with a carriage 12 of a known type, provided with wheels or bearings 14 suitable to slide in an extruded profile 16, made of aluminium or other suitable material. The profile 16 defines a substantially quadrangular cross-section, wherein the lower base is provided with a slot 18 longitudinally extending for the passage of a pin or bolt 20, which protrudes underneath from the carriage 12 and connects the same to the door or panel; the slot 18 extends centrally in the extruded profile 16, so that laterally opposite lips 22 remain along which the wheels or bearings 14 of the carriage 12 rest and slide. Said latter is connected to a containment shell 24, which houses the shock-absorbing unit, visible in particular in FIG. 2, comprising at least one helical spring 26, preferably a pair of helical springs 26, and a gas or other suitable type of shock absorbing piston 30. The containment shell 24 consists of opposite and complementary elements 28, each of which is provided on the inner front with a respective half-seat 32 for receiving and stabilizing the piston 30.

According to the invention, the shock-absorbing braking device 10 is provided with a slider 34, to which one of the ends of the helical springs 26 and the piston 30 is connected. In particular, the slider 34 is provided with opposite upper 36 and lower 38 protrusions, on which as many grooves 40 are formed; the extension hooks 42 made at the front end of each of the springs 26 engage in said grooves. The opposite end of the springs 26 is stabilized by a rear appendage 44 having a depression 44'; in it opposite protrusions 28' (FIG. 2) projecting inside the elements 28 forming the containment shell 24 when said elements are connected to each other with rivets 60 or equivalent retention means. The exposed end 30' of the piston rod 30 is engaged in a hole made along the rear wall of the slider 34; said slider has a lateral slot 46 through which an elastic ring 48 is inserted that makes the connection between the piston 30 and the slider 34. Preferably, a tube 50 is fitted on each spring 26 and a ring 52, in material suitable to reduce noise is fitted on the piston 30.

The slider 34 is provided at the front with a substantially cylindrical and horizontally extending integral appendage 54 for connecting said slider with a shaped cam 56; the cam 56 comprises a seat 58 with a substantially semi-circular profile in which the appendage 54 of the slider 34 is placed. The cam 56 as a whole may rotate at least in part with respect to said appendage 54 for the reasons specified below. In the opposite position with respect to the seat 58, a traction head or hook 62 protrudes from the cam 56 suitable to abut an activator described below, while from the opposite sides of said cam respective pins 64 protrude suitable to slide along a mixtilinear cavity 66 extending longitudinally along the inner face of each of the elements 28 forming the containment shell 24; one of the mixtilinear cavities 66 and one of the pins 64 are visible in FIG. 2. Said cavities extend mainly horizontally and curve downwards in the foremost part, in the proximity of the front head indicated as 24' of the containment shell 24, to form a bend 66' substantially at 90°. As may be seen in particular from FIG. 1, said front head 24' defines the element suitable to connect the containment shell 24 and the carriage 12 by means of screws 68. The containment shell 24 is inserted into a reinforcement profile 72 with a "U" cross-section (as shown in FIG. 2), provided with a plurality of opposite teeth 74 protruding inwards from the vertical walls of said profile; in parallel, the elements 28 of the containment shell 24 have a plurality of horizontal notches 70, into which the aforementioned teeth 74 (as shown in FIG. 2B) snap, thereby making the connection between said shell 24 and profile 72.

Two opposite wheels 76 are advantageously combined with the reinforcement profile 72 by means of pegs 76', in the position opposite the head 24' of the containment shell 24, to support and align the shock-absorbing braking device 10 as a whole inside the extruded profile 16.

Said device 10 further comprises an activator or actuating element 78, suitable to act in conjunction with the cam 56 and more particularly with the cam head or traction hook 62 thereof. The activator 78 comprises an arm 80, of suitable extension, one end of which is connected in a known manner to an underlying support base 82; the lower front of said support base is provided with two closely spaced holes 84, 86, respectively for a first screw or grub screw 84 'and for a second screw 86', as shown in FIGS. 1 and 3A; the first screw or grub screw 84 has the function of positioning the activator 78 in the extruded profile 16, while the second screw 86 pushes said activator to adhere to said profile. FIG. 3A illustrates the arrangement of an activator 78 in relation to a carriage 12, wherein the latter is fixed in a known manner to the underlying door or panel, schematically shown as 88, by the aforementioned pin or bolt 20. The support base 82 of the activator 78 is for example arranged and stabilized at the mouth of the extruded profile 16; preferably, in each extruded profile 16 opposite activators 78 are arranged, for the intervention of a shock-absorbing braking device 10 both when opening and closing the door or panel 88.

The arm 80 of the activator 78 is provided, at the end opposite the support base 82, with a lower protrusion 90, destined to be abutted by the traction head or hook 62 of the cam 56; this abutment occurs when the door or panel 88 is moved in opening or closing, a movement that in any case involves the application of a limited force. On the same arm 80, in its upper part facing the extruded profile 16, at least one elastic element 78 suitable to reduce vibration and therefore noise during the engagement phase between the protrusion 90 and the traction hook 62 is advantageously fixed. FIG. 5 shows the condition in which the position of the cam 56 corresponds to that of the door 88 arranged in a section between complete opening and closing, in which the pins 64 slide along the straight section of the cavity 66; said cam is therefore completely raised. FIG. 6 instead shows, starting from the previous condition illustrated in the area marked by a dashed line, the movement made by the cam 56 of partial downward rotation, which occurs after the pins have passed the 66' bent section of the cavity 66; it should be noted how the cam 56, which is rotated angularly, has reached the fully open position; the helical springs 26 are extended and the exposure of the rod 30' of the piston 30 has led to the advancement of the slider 34 and the cam 56 connected thereto. The carriage 12, connected by means of the screws 68 to the head 24' of the shell 24, has, at the same time, led the door or panel to be fully open. FIGS. 7, 8 and 9 show the progressive reverse movement of the cam 56 which, as a result of the manual intervention carried out by the user, rises and progressively returns to its original position as the pins 64 leave the bent section 66' of the cavities 66 and return to the horizontal part thereof; the springs 26 retract and drag the slider 34 with the cam 56 connected to it, while the rod 30' goes back into the structure of the piston 30, performing the braking of the door or panel 88 that is accompanied to the end stop. The carriage 12 thus drives the panel 88 to slide towards the closing position until it abuts the other shock-absorbing braking device 10 with its actuator 78, located in the opposite position in the extruded profile 16. The sliding of the panel 88 to the base, i.e. in the opposite position to the extruded profile 16, is performed in a known manner, for example by means of a pin 92 protruding from the floor and engaging in a cut of said door, as shown in FIG. 4. As may be seen from the above, the advantages which the invention achieves are evident.

In the shock-absorbing braking device of the present invention, especially suitable for sliding doors but also usable on wardrobe panels, the traction is not directly subjected to the movement determined by an elastic element, since the slider 34 is present to which the elastic element, in this case two springs 26, are connected; they are also not subjected to angular displacements and do not generate noise. In order to release it, moreover, it is necessary to apply a limited force in thrust or traction, so that even in this regard the noise that is transmitted to the panel 88 is extremely limited. The latter is moved and driven progressively to the respective end stops in opening and closing, protected from any risk related to impact or violent and noisy abutting.

Despite the invention having been described above with reference to one of its embodiments, given solely by way of a non-limiting example, numerous modifications and variants will appear evident to a person skilled in the art in the light of the above description. The present invention therefore sets out to embrace all the modifications and variants which fall within the sphere and scope of the following claims.

The invention claimed is:

1. A shock-absorbing braking device for sliding doors or for wardrobe panels, provided with a carriage with wheels sliding in an extruded profile having a lower base provided with a slot extending longitudinally from which a pin or bolt projects which connects said carriage to said sliding door or wardrobe panel, wherein the braking device comprises a containment shell, formed of opposite and complementary elements, in which at least one helical spring and a shock-absorbing piston are placed, acting in conjunction with a shaped cam with an appendage forming a traction hook suitable to abut an activator extending in said extruded profile, said shaped cam being provided on opposite sides with a pin designed to slide along a mixtilinear cavity extending longitudinally along the inner face of each of said elements forming the containment shell, further comprising a slider provided at the front with an integral appendage substantially cylindrical and extending horizontally for the connection of said slider to the shaped cam at a seat with a substantially semi-circular profile formed along said cam, one of the ends of the helical springs and of the piston being connected to the slider; and wherein the slider is provided with opposite upper and lower protrusions on which one or more grooves are formed in which the extension hooks made at the front end of each of the springs are engaged, the opposite rear end of said springs being provided with an appendage forming a depression in which opposite protrusions projecting inside the elements forming the containment shell are arranged.

2. The shock-absorbing device according to claim 1, wherein the exposed end of the rod of the piston is engaged in a hole made along the rear wall of the slider, provided laterally with a slot through which an elastic ring is inserted.

3. The shock-absorbing device according to claim 1, wherein said mixtilinear cavities extend mainly horizontally along opposite and complementary elements bending downwards substantially at 90° in the foremost part in the proximity of a front head of the containment shell, which defines the joining element between said containment shell and the carriage by screws.

4. The shock-absorbing device according to claim 1, wherein the activator comprises an arm, one end of which is connected to an underlying support base the lower front of which comprises two closely spaced holes and, respectively suitable to receive a first positioning screw or grub screw of said activator in the extruded profile and a second screw that pushes said activator to adhere to said extruded profile, on the same arm a protrusion being made designed to abut with the traction head or hook of the cam.

5. The shock-absorbing device according to claim 3, wherein the containment shell is inserted in a reinforcement profile having a "U" cross-section, provided with a plurality of opposite teeth protruding inwardly from the vertical walls of said profile and engaging in as many horizontal notches made on the elements of the containment shell, two opposite wheels being coupled by means of pegs to said reinforcement profile.

6. The shock-absorbing device according to claim 1, wherein on the inner front of each of the complementary elements forming the shell a semi-seat is made for receiving and stabilizing the piston, said elements being connected by rivets or equivalent means.

7. The shock-absorbing device according to claim 1, wherein on each spring and on the piston a tube and a ring in insulating material are respectively fitted.

8. A shock-absorbing braking device for sliding doors or for wardrobe panels, provided with a carriage with wheels sliding in an extruded profile having a lower base provided with a slot extending longitudinally from which a pin or bolt projects which connects said carriage to said sliding door or wardrobe panel, wherein the braking device comprises a containment shell, formed of opposite and complementary elements, in which at least one helical spring and a shock-absorbing piston are placed, acting in conjunction with a shaped cam with an appendage forming a traction hook suitable to abut an activator extending in said extruded profile, said shaped cam being provided on opposite sides with a pin designed to slide along a mixtilinear cavity extending longitudinally along the inner face of each of said elements forming the containment shell, further comprising a slider provided at the front with an integral appendage substantially cylindrical and extending horizontally for the connection of said slider to the shaped cam at a seat with a substantially semi-circular profile formed along said cam, one of the ends of the helical springs and of the piston being connected to the slider, and wherein the activator comprises an arm, one end of which is connected to an underlying support base the lower front of which comprises two closely spaced holes and, respectively suitable to receive a first positioning screw or grub screw of said activator in the extruded profile and a second screw that pushes said activator to adhere to said extruded profile, on the same arm a protrusion being made designed to abut with the traction head or hook of the cam.

9. The shock-absorbing device according to claim 8, wherein the exposed end of the rod of the piston is engaged in a hole made along the rear wall of the slider, provided laterally with a slot through which an elastic ring is inserted.

10. The shock-absorbing device according to claim 8, characterized in that the slider is provided with opposite upper and lower protrusions on which as many grooves are formed in which the extension hooks made at the front end of each of the springs are engaged, the opposite rear end of said springs being provided with an appendage forming a depression in which opposite protrusions projecting inside the elements forming the containment shell are arranged.

11. The shock-absorbing device according to claim 8, wherein said mixtilinear cavities extend mainly horizontally along opposite and complementary elements bending downwards substantially at 90° in the foremost part in the proximity of a front head of the containment shell, which defines the joining element between said containment shell and the carriage by screws.

12. The shock-absorbing device according to claim 11, wherein the containment shell is inserted in a reinforcement profile having a "U" cross-section, provided with a plurality of opposite teeth protruding inwardly from the vertical walls of said profile and engaging in as many horizontal notches made on the elements of the containment shell, two opposite wheels being coupled by means of pegs to said reinforcement profile.

13. The shock-absorbing device according to claim 8, wherein on the inner front of each of the complementary elements forming the shell a semi-seat is made for receiving and stabilizing the piston, said elements being connected by rivets or equivalent means.

14. The shock-absorbing device according to claim 8, wherein on each spring and on the piston a tube and a ring in insulating material are respectively fitted.

* * * * *